United States Patent [19]

Reiling et al.

[11] Patent Number: 4,674,234

[45] Date of Patent: Jun. 23, 1987

[54] ABRASIVE TOOL

[76] Inventors: Reinhold Reiling; Karl Reiling, both of Remchinger Str. 4, D-7535 Königsbach-Stein, Fed. Rep. of Germany

[21] Appl. No.: 790,191

[22] Filed: Oct. 22, 1985

[30] Foreign Application Priority Data

Oct. 26, 1984 [DE] Fed. Rep. of Germany ..... 3439230

[51] Int. Cl.[4] ..... B24B 45/00

[52] U.S. Cl. ..... 51/168; 51/358; 464/89

[58] Field of Search ..... 464/87, 89, 92; 51/168, 51/358

[56] References Cited

U.S. PATENT DOCUMENTS

| | | | |
|---|---|---|---|
| 2,269,799 | 1/1942 | Upson | 464/89 |
| 2,290,011 | 7/1942 | Bahr | 464/89 |
| 2,371,021 | 3/1945 | Berry | 51/358 |
| 2,629,990 | 3/1953 | Guilbert | 51/168 |
| 2,666,307 | 1/1954 | Higert | 51/168 |
| 3,068,664 | 12/1962 | Guilbert | 464/89 |
| 4,479,786 | 10/1984 | Bisschop | 464/89 |

FOREIGN PATENT DOCUMENTS

| | | | |
|---|---|---|---|
| 3222858 | 5/1983 | Fed. Rep. of Germany | 51/358 |

*Primary Examiner*—Harold D. Whitehead

*Attorney, Agent, or Firm*—Balogh, Kramer, Dvorak, Genova & Traub

[57] ABSTRACT

In an abrasive tool for grinding or polishing, a grippable shaft is connected to an abrasive disc by means of a cylindrical elastic pad of plastic or rubber. A surrounding cap, preferably a screw cap, is provided, which for stiffening the assembly is adapted to be secured at one end to the abrasive disc and is engageable at its other end by means of an annular shoulder to an annular shoulder of the grippable shaft. Alternatively, the grippable shaft may extend through a cylindrical elastic ring of plastic or rubber, which ring is surrounded to a metal sleeve, which is connected to the abrasive disc and adapted to be tightened by a nut so as to stiffen the tool.

2 Claims, 4 Drawing Figures

ABRASIVE TOOL

BACKGROUND OF THE INVENTION

1. Field of the Invention

This invention relates in a first aspect to an abrasive tool for grinding or polishing, comprising a grippable shaft having an end flange, an abrasive disc having a fixing flange, and an elastomeric pad, which is disposed between and vulcanization-bonded to said flanges.

In another aspect the invention relates to an abrasive tool for grinding or polishing, comprising a grippable shaft formed with external screw threads and provided with an end flange, a sleeve, and an annular elastomeric pad which is disposed between and vulcanization-bonded to said shaft and to said sleeve.

2. Description of the Prior Art

U.S. Pat. No. 2,629,990 discloses a grinding disc, which is provided with a grippable shaft having an end flange, which is connected by a vulcanization-bonded elastomeric pad to a fixing flange of the grinding disc. That design has been adopted to ensure a resilient contact between the disc and the workpiece.

Published German Application No. 33 01 210 discloses a carrying head for machining discs, which head comprises a grippable shaft and an end flange. The grippable shaft is provided with screw threads and is vulcanization-bonded to an elastomeric pad, which is surrounded by a sleeve. That proposal is concerned with the provision of a movable carrying head which can yield without a jerk.

Published German Application No. 32 22 858 relates to a grinding or polishing tool comprising an abrasive disc, which is provided with a grinding or polishing abrasive and which by means of an end piece of a flexible shaft is adapted to be connected to a driving chuck. The flexible shaft is adapted to be stiffened by means of a rigid member which is adapted to be inserted into or fitted on said shaft.

It has thus been disclosed that a grinding disc can be driven by means of a flexible shaft, which can be stiffened by a rigid member that is inserted into or fitted on the shaft so that one and the same apparatus can be used for grinding and polishing flat surfaces when the shaft has been stiffened. In the use of such discs it has been found that the flexible shafts may break under excessive stresses when they are operated under heavy loads, which may be due to the size of the grinding disc or to high speeds, which in angle grinders may amount to about 9000 r.p.m. whereas only speeds of about 3000 r.p.m. are required in drilling or boring machines.

SUMMARY OF THE INVENTION

It is an object of the invention to provide an abrasive tool which is less susceptible to breakage even under heavy loads and at high speeds.

This object is accomplished in accordance with the first aspect of the invention in that the end flange and the elastomeric pad are surrounded by a pot-shaped sleeve, which is adapted to be screw-threadedly connected to external screw threads of the fixing flange.

In an abrasive disc in accordance with the second aspect of the invention the object set forth hereinbefore can be accomplished in that a nut is adapted to be screwed to the screw threads of the shaft and engageable with the rear end of the sleeve and the abrasive disc is carried by the sleeve at its forward end.

Both arrangements produce the surprising results that the breaking strength is increased, the elasticity is improved and the tool can be manufactured at lower costs.

DETAILED DESCRIPTION OF THE PREFERRED EMBODIMENTS

Figure 1:
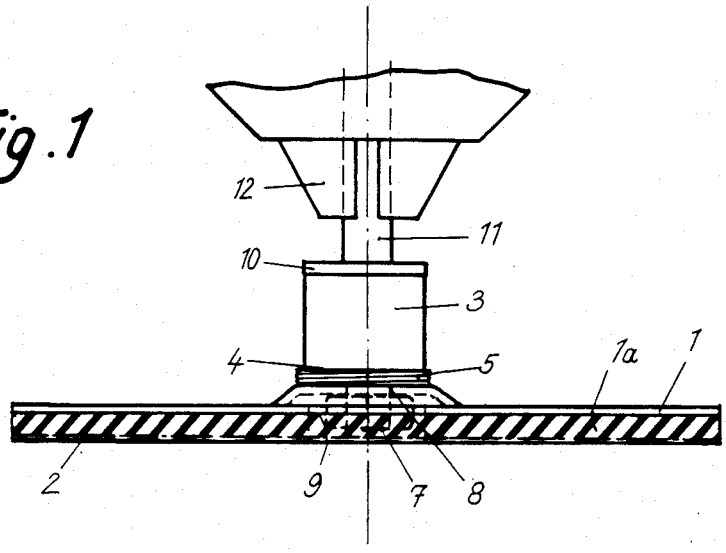
FIGS. 1 and 2 show a first embodiment of an abrasive tool having an abrasive disc, which is flexibly connected to the driving chuck in FIG. 1 and is rigidly connected there to in FIG. 2.

Two preferred embodiments of an abrasive tool in accordance with the invention will now be described more in detail with reference to the drawing.

Figure 2:
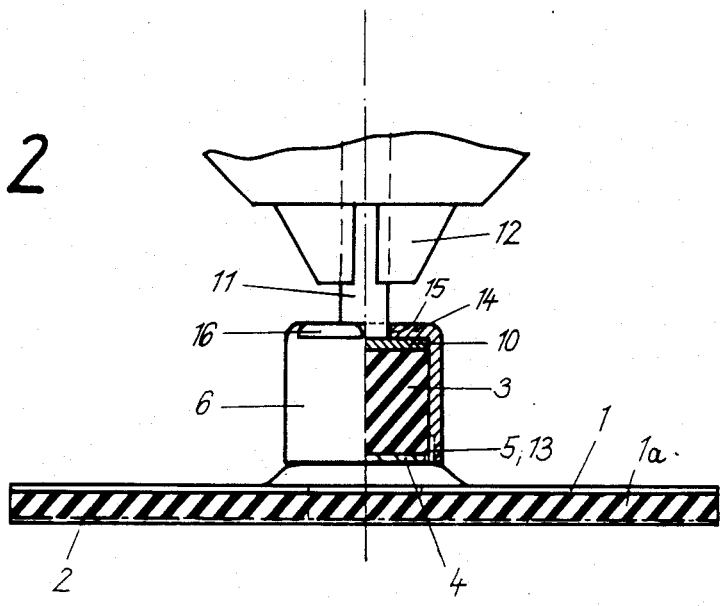

The abrasive tool shown in FIGS. 1 and 2 comprises a disc body 1, which is made of hard plastic material or preferably of steel and carries a rubber layer *1a* provided with a covering 2 of abrasive material for grinding or polishing. That covering 2 may be detachably secured to the rubber layer 1*a*, e.g., by means of a velcro fastener. A cylindrical pad 3 of a synthetic elastomer or rubber is vulcanization-bonded on one side to a fixing flange 4, which is formed with external screw threads 5 for a screw-threaded connection to a pot-shaped sleeve 6. The fixing flange 4 is provided with a screw-threaded pin 7 for a screw-threaded connection to an internal screw thread in a central bore 8 of the disc body 1 and to a lock nut 9 disposed on the side of the disc body 1 that is opposite to the flange 4. The elastomeric pad 3 is vulcanization-bonded on its other side to a radial flange 10, which is carried by a shaft 11, which is adapted to be gripped by the driving chuck 12.

The pot-shaped sleeve 6 is provided at its open end with internal screw threads 13, which fit the external screw threads 5 of the mounting flange 4. The sleeve 6 has at its opposite end a bottom 14, which is formed with a central opening 15 and is engageable with the flange 10 of the grippable shaft. It is apparent that in dependence on the diameter of the disc body 1 the elastomeric pad 3 is much larger in diameter than the grippable shaft 11. That design results in a high stability and long useful line during grinding and polising operations even at very high speeds.

To permit the pot-shaped sleeve 6 to be mounted and removed, the same is formed at its outer edge 16 with grooves or flats. When the sleeve 6 has been removed, the disc body 1 can be flexibly connected for a grinding or polishing of flat surfaces without a formation of unilateral scores by grinding or polishing. When the pot-shaped sleeve 6 has been mounted but has not been tightened, the disc body 1 will be laterally movable between limits which depend also on the size of the central opening 15 in the bottom 14 and on the diameter of the grippable shaft 1. When the sleeve 6 has been tightened the disc body 1 will be rigidly connected to the driving chuck 12, as is desirable, inter alia, for a satisfactory grinding of edges.

The second embodiment shown in FIG. 1 comprises a disc body 17 made of plastic or preferably of steel and carrying a rubber layer 17*a* that is provided with an abrasive covering 18, which is detachably connected to the layer 17*a*, e.g., by means of a velcro fastener. The shaft 19 which is adapted to be gripped in a driving chuck 19 is surrounded at its opposite end by an elastomeric pad 21 consisting of plastic or rubber and is vulcanization bonded to the shaft 19 and to a surrounding metal sleeve 22, which has external screw threads 23 for screw-threaded connection to internal screw threads 24 of the disc body 17.

In this embodiment the stiffening means comprise a nut 25, which is screwed to the screw threads 25*a* of the grippable shaft 19 and adapted to be forced against the sleeve 22, which surrounds the elastomeric pad 21. At that end which is opposite to the elastomeric pad 21, the grippable shaft 19 may be provided with an end flange 26 as an abutment for the sleeve 22. To permit an assembling from above, the flange 26 is set back in such a manner that it can be inserted through the internal screw threads 24 of the disc body 17 and by tightening of the screw 25 can be forced against the end of the sleeve 22. If the flange 26 is relatively large, it may be adapted to be mounted from below. In that case the flange 26 is screwed into screw threads on an end portion of the grippable shaft 19 and fixed by an adhesive joint.

Figure 3:
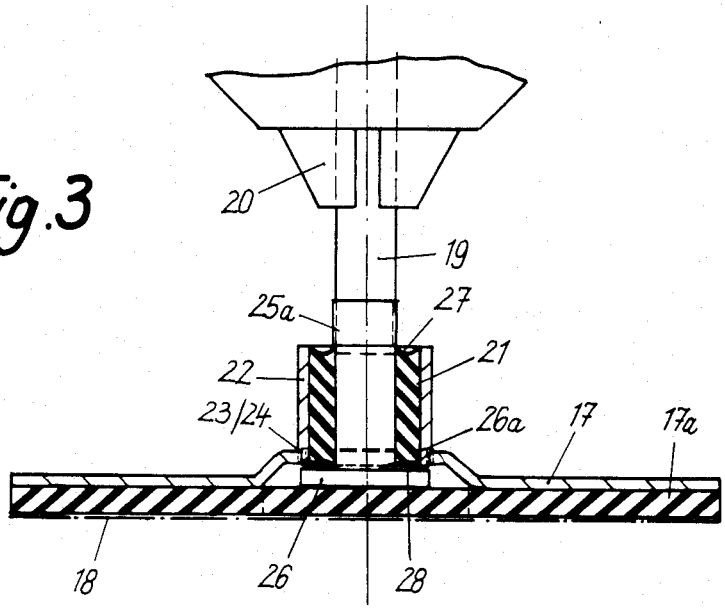
FIGS. 3 and 4 show a second embodiment of an abrasive tool having an abrasive disc, which is flexibly connected to the driving chuck in FIG. 3 and is rigidly connected thereto in FIG. 4.
Figure 4:
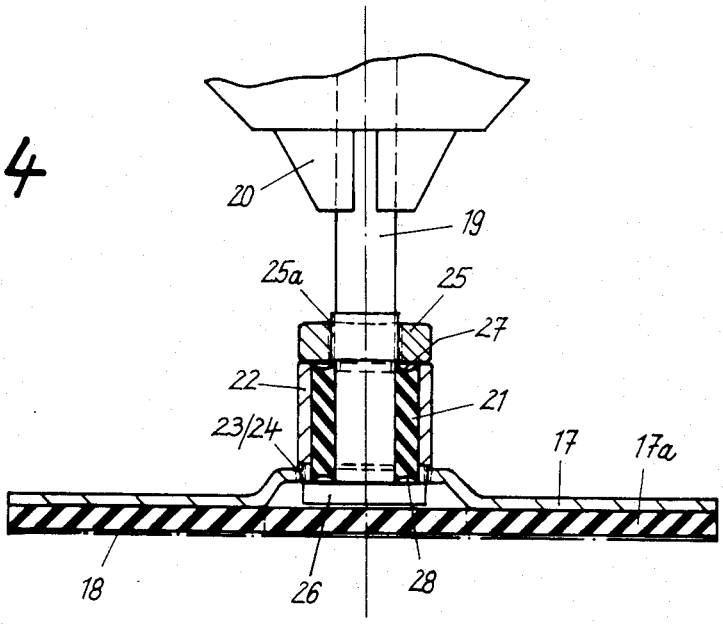

As the nut 25 is tightened, the clearance 26*a* shown in FIG. 3 is eliminated so that the parts are rigidly firmly forced against each other, as is shown in FIG. 4, so that the disc body 17 is rigidly mounted. To facilitate the tightening of the nut 25, the vulcanization-bonded elastomeric pad is formed in each end face with an annular groove 27 or 28. The object underlying the invention can be accomplished in an even more optimum and reliable manner with that second embodiment.

The embodiments shown in FIGS. 2 and 4 may be combined in such a manner that the end flange 10 and the elastomeric pad 3 are surrounded by a pot-shaped sleeve 6, as is shown in FIG. 2, and said sleeve 6 is in snug contact with the outside peripheral surface of a ring which is carried by the fixing flange 4 shown in FIG. 4 and surrounds the pad 3. The sleeve 10 is adapted to be releasably secured to the shaft 19 of FIG. 4, preferably by a nut 25, which is screwed on the screw threads 25*a* of the shaft.

What is claimed is:

1. In an abrasive tool comprising a grippable shaft, a radial first flange carried by said shaft, an abrasive disc which has an abrasive forward surface and a rear surface facing and axially spaced from said first flange, a second flange secured and non-rotatably connected to said abrasive disc on said rear surface, and an elastomeric pad, which is disposed between and vulcanization-bonded to said first and second flanges and adapted to transmit torque between them, the improvement residing in that said second flange is formed with external screw threads and a pot-shaped sleeve surrounds said pad and said first flange and is open at one end and is formed at said one end with internal screw threads in threaded engagement with said external screw threads, said sleeve having at its other end an apertured bottom, which surrounds said shaft and bears on said first flange on that side thereof which is opposite to said pad, whereby the flexibility of the abrasive disc can be adjusted by screw-threadedly tightening said pot-shaped sleeve to control the lateral movement of said abrasive disc.

2. In an abrasive tool comprising a grippable shaft, a radial first flange carried by said shaft, an abrasive disc which has an abrasive forward surface and a rear surface facing and axially spaced from said first flange, a second flange secured and non-rotatably connected to said abrasive disc on said rear surface, and an elastomeric pad, which is disposed between and vulcanization-bonded to said first and second flanges and adapted to transmit torque between them, the improvement residing in that a pot-shaped sleeve surrounds said pad and said first flange and is open at one end and has at its other end an apertured bottom, which surrounds said shaft and bears on said first flange on that side thereof which is opposite to said pad and screw means are provided for forcing said bottom against said first flange and for forcing said sleeve at said one end against said second flange, whereby the flexibility of the abrasive disc can be adjusted by screw-threadedly tightening said pot-shaped sleeve to control the lateral movement of said abrasive disc.

* * * * *